US007390200B2

(12) United States Patent
Shuey et al.

(10) Patent No.: US 7,390,200 B2
(45) Date of Patent: Jun. 24, 2008

(54) HIGH SPEED DIFFERENTIAL TRANSMISSION STRUCTURES WITHOUT GROUNDS

(75) Inventors: Joseph B Shuey, Camp Hill, PA (US); Stephen B. Smith, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/918,142

(22) Filed: Aug. 13, 2004

(65) Prior Publication Data

US 2006/0035530 A1 Feb. 16, 2006

Related U.S. Application Data

(63) Continuation of application No. 10/294,966, filed on Nov. 14, 2002, now Pat. No. 6,976,886, and a continuation-in-part of application No. 10/155,786, filed on May 24, 2002, now Pat. No. 6,652,318, which is a continuation-in-part of application No. 09/990,794, filed on Nov. 14, 2001, now Pat. No. 6,692,272.

(51) Int. Cl.
*H01R 12/00* (2006.01)

(52) U.S. Cl. ..... 439/79

(58) Field of Classification Search ..... 439/74, 439/608, 79, 108, 701
See application file for complete search history.

(56) References Cited

U.S. PATENT DOCUMENTS

| | | | | |
|---|---|---|---|---|
| 3,286,220 | A | 11/1966 | Marley et al. | 439/680 |
| 3,538,486 | A | 11/1970 | Shlesinger, Jr. | 439/268 |
| 3,669,054 | A | 6/1972 | Desso et al. | 113/119 |
| 3,748,633 | A | 7/1973 | Lundergan | 339/217 |
| 4,076,362 | A | 2/1978 | Ichimura | 339/75 |
| 4,159,861 | A | 7/1979 | Anhalt | 339/75 |
| 4,260,212 | A | 4/1981 | Ritchie et al. | 339/97 |
| 4,288,139 | A | 9/1981 | Cobaugh et al. | 339/74 |
| 4,383,724 | A | 5/1983 | Verhoevan | 439/510 |
| 4,402,563 | A | 9/1983 | Sinclair | 339/75 |
| 4,560,222 | A | 12/1985 | Dambach | 339/75 |
| 4,717,360 | A | 1/1988 | Czaja | 439/710 |
| 4,776,803 | A | 10/1988 | Pretchel et al. | 439/59 |
| 4,815,987 | A | 3/1989 | Kawano et al. | 439/263 |

(Continued)

FOREIGN PATENT DOCUMENTS

EP 0 273 683 A2 7/1988

(Continued)

OTHER PUBLICATIONS

Nadolny, J. et al., "Optimizing Connector Selection for Gigabit Signal Speeds", *ECN*™, Sep. 1, 2000, http://www.ecnmag.com/article/CA45245, 6 pages.

(Continued)

*Primary Examiner*—Ross Gushi
(74) *Attorney, Agent, or Firm*—Woodcock Washburn LLP

(57) ABSTRACT

A high-speed electrical connector is disclosed. The high-speed electrical connector connects a first electrical device having a first ground reference to a second electrical device having a second ground reference. The connector, which includes a connector housing and a signal contact, is devoid of any ground connection that is adapted to electrically connect the first ground reference and the second ground reference.

29 Claims, 16 Drawing Sheets

U.S. PATENT DOCUMENTS 4,867,713 A 9/1989 Ozu et al. ..... 439/833
4,907,990 A 3/1990 Bertho et al. ..... 439/851
4,913,664 A 4/1990 Dixon et al. ..... 439/607
4,973,271 A 11/1990 Ishizuka et al. ..... 439/839
5,066,236 A 11/1991 Broeksteeg ..... 439/79
5,077,893 A 1/1992 Mosquera et al. ..... 29/882
5,163,849 A 11/1992 Fogg et al. ..... 439/497
5,167,528 A 12/1992 Nishiyama et al. ..... 439/489
5,174,770 A 12/1992 Sasaki et al. ..... 439/108
5,238,414 A 8/1993 Yaegashi et al. ..... 439/108
5,254,012 A 10/1993 Wang ..... 439/263
5,274,918 A 1/1994 Reed ..... 29/882
5,277,624 A 1/1994 Champion et al. ..... 439/607
5,286,212 A 2/1994 Broekstagg ..... 439/108
5,302,135 A 4/1994 Lee ..... 439/263
5,342,211 A 8/1994 Broekstagg ..... 439/108
5,356,300 A 10/1994 Costello et al. ..... 439/101
5,356,301 A 10/1994 Champion et al. ..... 439/108
5,357,050 A 10/1994 Baran et al. ..... 174/33
5,431,578 A 7/1995 Wayne ..... 439/259
5,475,922 A 12/1995 Tamura et al. ..... 29/881
5,558,542 A 9/1996 O'Sullivan et al. ..... 439/682
5,586,914 A 12/1996 Foster, Jr. et al. ..... 439/676
5,590,463 A 1/1997 Feldman et al. ..... 29/844
5,609,502 A 3/1997 Thumma ..... 439/747
5,713,746 A 2/1998 Olson et al. ..... 439/79
5,730,609 A 3/1998 Harwath ..... 439/108
5,741,144 A 4/1998 Elco et al. ..... 439/101
5,741,161 A 4/1998 Cahaly et al. ..... 439/709
5,795,191 A 8/1998 Preputnick et al. ..... 439/608
5,817,973 A 10/1998 Elco et al. ..... 174/32
5,853,797 A 12/1998 Fuchs et al. ..... 427/96
5,908,333 A 6/1999 Perino et al. ..... 439/631
5,961,355 A 10/1999 Morlion et al. ..... 439/686
5,967,844 A 10/1999 Doutrich et al. ..... 439/607
5,971,817 A 10/1999 Longueville ..... 439/857
5,980,321 A 11/1999 Cohen et al. ..... 439/608
5,993,259 A 11/1999 Stokoe et al. ..... 439/608
6,050,862 A 4/2000 Ishii ..... 439/843
6,068,520 A 5/2000 Winings et al. ..... 439/676
6,116,926 A 9/2000 Ortega et al. ..... 439/108
6,116,965 A * 9/2000 Arnett et al. ..... 439/692
6,123,554 A 9/2000 Ortega et al. ..... 439/79
6,125,535 A 10/2000 Chiou et al. ..... 29/883
6,129,592 A 10/2000 Mickievicz et al. ..... 439/701
6,139,336 A 10/2000 Olson ..... 439/83
6,146,157 A 11/2000 Lenoir et al. ..... 439/101
6,146,203 A 11/2000 Elco et al. ..... 439/608
6,171,115 B1 1/2001 Mickievicz et al. ..... 439/76.1
6,171,149 B1 1/2001 Van Zanten ..... 439/608
6,190,213 B1 2/2001 Reichart et al. ..... 439/736
6,212,755 B1 4/2001 Shimada et al. ..... 29/527.1
6,219,913 B1 4/2001 Uchiyama ..... 29/883
6,220,896 B1 4/2001 Bertoncici et al. ..... 439/608
6,227,882 B1 5/2001 Ortega et al. ..... 439/101
6,267,604 B1 7/2001 Mickievicz et al. ..... 439/79
6,269,539 B1 8/2001 Takahashi et al. ..... 29/883
6,280,209 B1 8/2001 Bassler et al. ..... 439/101
6,293,827 B1 9/2001 Stokoe et al. ..... 439/608
6,319,075 B1 11/2001 Clark et al. ..... 439/825
6,322,379 B1 11/2001 Ortega et al. ..... 439/108
6,322,393 B1 11/2001 Doutrich et al. ..... 439/607
6,328,602 B1 12/2001 Yamasaki et al. ..... 439/608
6,343,955 B2 2/2002 Billman et al. ..... 439/608
6,347,952 B1 2/2002 Hasegawa et al. ..... 439/608
6,350,134 B1 2/2002 Fogg et al. ..... 439/79
6,354,877 B1 3/2002 Shuey et al. ..... 439/608
6,358,061 B1 3/2002 Regnier ..... 439/60
6,361,366 B1 3/2002 Shuey et al. ..... 439/608
6,363,607 B1 4/2002 Chen et al. ..... 29/883
6,364,710 B1 4/2002 Billman et al. ..... 439/608
6,371,773 B1 4/2002 Crofoot et al. ..... 439/79
6,375,478 B1 4/2002 Kikuchi ..... 439/79
6,379,188 B1 4/2002 Cohen et al. ..... 439/608
6,386,914 B1 5/2002 Collins et al. ..... 439/579
6,409,543 B1 6/2002 Astbury, Jr. et al. ..... 439/608
6,431,914 B1 8/2002 Billman ..... 439/608
6,435,914 B1 8/2002 Billman ..... 439/608
6,461,202 B2 10/2002 Kline ..... 439/701
6,471,548 B2 10/2002 Bertoncini et al. ..... 439/608
6,482,038 B2 11/2002 Olson ..... 439/608
6,485,330 B1 11/2002 Doutrich ..... 439/572
6,494,734 B1 12/2002 Shuey ..... 439/378
6,506,081 B2 1/2003 Blanchfield et al. ..... 439/682
6,520,803 B1 2/2003 Dunn ..... 439/608
6,527,587 B1 3/2003 Ortega et al. ..... 439/608
6,537,111 B2 3/2003 Brammer et al. ..... 439/857
6,540,559 B1 4/2003 Kemmick et al. ..... 439/608
6,547,066 B2 4/2003 Koch ..... 206/308.1
6,554,647 B1 4/2003 Cohen et al. ..... 439/607
6,572,410 B1 6/2003 Volstorf et al. ..... 439/608
6,652,318 B1 11/2003 Winings et al. ..... 439/608
6,692,272 B2 2/2004 Lemke et al. ..... 439/108
6,695,627 B2 2/2004 Ortega et al. ..... 439/78
6,764,341 B2 7/2004 Lappoehn ..... 439/608
6,776,649 B2 8/2004 Pape et al. ..... 439/485
6,808,399 B2 10/2004 Rothermel et al. ..... 439/108
6,843,686 B2 1/2005 Ohnishi et al. ..... 439/608
6,848,944 B2 2/2005 Evans ..... 439/608
6,851,974 B2 2/2005 Doutrich ..... 439/572
6,869,292 B2 3/2005 Johnescu et al. ..... 439/74
6,890,214 B2 5/2005 Brown et al.
6,913,490 B2 7/2005 Whiteman, Jr. et al. ..... 439/608
6,932,649 B1 8/2005 Rothermel et al. ..... 439/620
6,945,796 B2 9/2005 Bassler et al. ..... 439/101
6,953,351 B2 10/2005 Fromm et al.
6,969,280 B2 11/2005 Chien et al. ..... 439/608
6,981,883 B2 1/2006 Raistrick et al. ..... 439/74
7,097,506 B2 8/2006 Nakada ..... 439/608
7,131,870 B2 11/2006 Whiteman, Jr. et al.
2002/0098727 A1* 7/2002 McNamara et al. ..... 439/108
2002/0106930 A1 8/2002 Pape et al. ..... 439/485
2003/0143894 A1 7/2003 Kline et al. ..... 439/608
2003/0171010 A1 9/2003 Winings et al. ..... 439/55
2003/0203665 A1 10/2003 Ohnishi et al. ..... 439/79
2003/0220021 A1 11/2003 Whiteman, Jr. et al. ..... 439/608
2005/0009402 A1 1/2005 Chien et al. ..... 439/608
2005/0118869 A1 6/2005 Evans ..... 439/608
2006/0014433 A1 1/2006 Consoli et al. ..... 439/608

FOREIGN PATENT DOCUMENTS

EP 0 891 016 10/2002
EP 1 148 587 B1 4/2005
JP 06-236788 8/1994
JP 07-114958 5/1995
JP 11-185 886 7/1999
JP 2000-003743 1/2000
JP 2000-003744 1/2000
JP 2000-003745 1/2000
JP 2000-003746 1/2000
WO WO 90/16093 12/1990
WO WO 01/29931 A1 4/2001
WO WO 01/39332 A1 5/2001
WO WO 02/101882 12/2002

OTHER PUBLICATIONS

"PCB-Mounted Receptacle Assemblies, 2.00 mm(0.079in) Centerlines, Right-Angle Solder-to-Board Signal Receptacle", *Metral™*, Berg Electronics, 10-6-10-7.

Fusi, M.A. et al., "Differential Signal Transmission through Backplanes and Connectors", *Electronic Packaging and Production*, Mar. 1996, 27-31.

Goel, R.P. et al., "AMP Z-Pack Interconnect System", 1990, AMP Incorporated, 9 pages.
"FCI's Airmax VS® Connector System Honored at DesignCon", 2005, Heilind Electronics, Inc., http://www.heilind.com/products/fci/airmax-vs-design.asp, 1 page.
Hult, B., "FCI's Problem Solving Approach Changes Market, The FCI Electronics AirMax VS®", ConnectorSupplier.com, Http://www.connectorsupplier.com/tech_updates_FCI-Airmax_archive.htm, 2006, 4 pages.
Backplane Products Overview Page, http://www.molex.com/cgi-bin/bv/molex/super_family/super_family.jsp?BV_Session ID=@, 2005-2006 © Molex, 4 pages.
AMP Z-Pack 2mm HM Interconnection System, 1992 and 1994 © by AMP Incorporated, 6 pages.
Metral® 2mm High-Speed Connectors, 1000, 2000, 3000 Series, Electrical Performance Data for Differential Applications, FCI Framatome Group, 2 pages.
HDM® HDM Plus® Connectors, http://www.teradyne.com/prods/tcs/products/connectors/backplane/hdm/index.html, 2006, 1 page.
Amphenol TCS (ATCS):HDM® Stacker Signal Integrity, http://www.teradyne.com/prods/tcs/products/connectors/mezzanine/hdm_stacker/signintegr, 3 pages.
Amphenol TCS (ATCS): VHDM Connector, http://www.teradyne.com/prods/tcs/products/connectors/backplane/vhdm/index.html, 2 pages.
VHDM High-Speed Differential (VHDM HSD), http://www.teradyne.com/prods/bps/vhdm/hsd.html, 6 pages.
Amphenol TCS(ATCS): VHDM L-Series Connector, http://www.teradyne.com/prods/tcs/products/connectors/backplane/vhdm_1-series/index.html, 2006, 4 pages.
VHDM Daughterboard Connectors Feature press-fit Terminations and a Non-Stubbing Seperable Interface, © Teradyne, Inc. Connections Systems Division, Oct. 8, 1997, 46 pages.
HDM/HDM *plus*, 2mm Backplane Interconnection System, Teradyne Connection Systems, © 1993, 22 pages.
HDM Separable Interface Detail, Molex®, 3 pages.
"Lucent Technologies' Bell Labs and FCI Demonstrate 25gb/S Data Transmission over Electrical Backplane Connectors", Feb. 1, 2005, http://www.lucent.com/press/0205/050201.bla.html, 4 pages.
"B.? Bandwidth and Rise Time Budgets", Module 1-8. Fiber Optic Telecommunications (E-XVI-2a), http://cord.org/step_online/st1-8/st18exvi2a.htm, 3 pages.
*Metral*™ "Speed & Density Extensions", FCI, Jun. 3, 1999, 25 pages.
Framatome Connector Specification, 1 page.
MILLIPACS Connector Type A Specification, 1 page.
AMP Z-Pack 2mm HM Connector, 2mm Centerline, Eight-Row, Right-Angle Applications, Electrical Performance Report, EPR 889065, Issued Sep. 1998, 59 pages.
AMP Z-Pack HM-Zd Performance at Gigabit Speeds, Tyco Electronics, Report #20GC014, Rev.B., May 4, 2001, 30 pages.
Gig-Array® High Speed Mezzanine Connectors 15-40 mm Board to Board, Jun. 5, 2006, 1 page.
Communications, Data, Consumer Division Mezzanine High-Speed High-Density Connectors Gig-Array® and Meg-Array® electrical Performance Data, 10 pages FCI Corporation.
Honda Connectors, "Honda High-Speed Backplane connector NSP Series", Honda Tsushin Kogoyo Co., Ltd., Development Engineering Division, Tokyo, Japan, Feb. 7, 2003, 25 pages.
NSP, Honda The World Famous Connectors, http://www.honda-connectors.co.jp, 6 pages English Language Translation attached.
4.0 UHD Connector: Differential Signal Crosstalk, Reflections, 1998, p. 8-9.

* cited by examiner

Jitter After Severed Ground

| Skew amount | 0ps | 2ps | 4ps | 6ps | 8ps | 10ps | 20ps | 50ps | 100ps | 200ps |
|---|---|---|---|---|---|---|---|---|---|---|
| 6.25Gb/s Pair3 | 19.2 | 22.2 | 22.2 | 19.2 | 20.4 | 16.8 | 19.8 | 22.2 | 61.2 | Too much skew |
| 10 Gb/s Pair3 | 12.8 | 14.8 | 14.8 | 14 | 11.6 | 20.4 | 12.8 | 27.6 | Too much skew | |

FIG. 7A

Eye Height at 40% of the Unit Interval After Severing the Ground

| Skew amount | 0ps | 2ps | 4ps | 6ps | 8ps | 10ps | 20ps | 50ps | 100ps | 200ps |
|---|---|---|---|---|---|---|---|---|---|---|
| 6.25Gb/s Pair3 | 819 | 825 | 831 | 837 | 840 | 834 | 819 | 729 | 249 | Too much skew |
| 10 Gb/s Pair3 | 669 | 669 | 675 | 669 | 657 | 633 | 633 | 345 | Too much skew | |

FIG. 7B

HIGH SPEED DIFFERENTIAL TRANSMISSION STRUCTURES WITHOUT GROUNDS

CROSS-REFERENCE TO RELATED APPLICATIONS

This application is a continuation of U.S. patent application Ser. No. 10/294,966, filed Nov. 14, 2002, now U.S. Pat. No. 6,976,886, which is a continuation-in-part of U.S. patent application Ser. No. 09/990,794, filed Nov. 14, 2001, now U.S. Pat. No. 6,692,272, and Ser. No. 10/155,786, filed May 24, 2002, now U.S. Pat. No. 6,652,318.

The subject matter disclosed and claimed herein is related to the subject matter disclosed and claimed in U.S. patent application Ser. No. 10/917,994, filed on even date herewith, and entitled "High speed electrical connector without ground contacts."

The contents of each of the above-referenced U.S. patents and patent applications is herein incorporated by reference in its entirety.

FIELD OF THE INVENTION

Generally, the invention relates to the field of electrical connectors. More particularly, the invention relates to lightweight, low cost, high density electrical connectors that provide impedance controlled, high speed, low interference communications, even in the absence of ground contacts adapted to connect the ground plane on one electrical device to another ground plane in another electrical device.

BACKGROUND OF THE INVENTION

Electrical connectors provide signal connections between electronic devices using signal contacts. Often, the signal contacts are so closely spaced that undesirable interference, or "cross talk," occurs between adjacent signal contacts. Cross talk occurs when a signal on one signal contact induces electrical interference in an adjacent signal contact due to intermingling electrical fields, thereby compromising signal integrity. With electronic device miniaturization and high speed, high signal integrity electronic communications becoming more prevalent, the reduction of noise becomes a significant factor in connector design.

One known method for reducing signal interference includes the use of ground connections that connect the ground reference of a first, or "near-end," electrical device to the ground reference of a second, or "far-end," electrical device. The terms "near end" and "far end" are relative terms commonly used in the electrical connector field to refer to the ground references of the devices that the connector connects. The near-end device is the device that transmits a signal through the signal contacts; the far-end device is the device that receives the signal. The near end is the transmission side; the far end is the receiver side. The ground connections help to provide a common reference point in the electrical system such that the signal integrity of the signal passed from the near-end device through the connector to the far-end device is maintained.

Though some prior art electrical connectors do not have ground connections that connect near- and far-end ground references, such prior art electrical connectors operate at relatively slow speeds (e.g., <1 Gb/s). Such slower speed applications typically do not need a common reference point to maintain signal integrity. Some slower speed applications for electrical connectors with no connecting grounds include, for example, tip and ring on a telephone line.

There is a need, however, for a high speed electrical connector (i.e., operating above 1 Gb/s and typically in the range of about 10-20 Gb/s) that is devoid of ground connections between the ground reference of a near-end electrical device and the ground reference of a far-end electrical device to help increase density.

SUMMARY OF THE INVENTION

The invention provides a high-speed electrical connector (operating above 1 Gb/s and typically in the range of about 10-20 Gb/s) that is devoid of any ground connections within the array that connect the ground reference of one electrical device connected to the connector to the ground reference of another electrical device connected to the connector.

Particularly, in one embodiment of the invention, a high speed electrical connector is disclosed that connects a first electrical device having a first ground reference to a second electrical device having a second ground reference. The connector, which may include a connector housing and one or more signal contacts, is devoid of any ground connection between the ground reference of a first electrical device connected to the connector and the ground reference of a second electrical device connected to the connector.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein:

FIGS. 7A and 7B illustrate jitter and eye height test results using a 6.25 and 10 Gb/s test signal as performed on the differential signal pair of FIG. 3;

DETAILED DESCRIPTION OF ILLUSTRATIVE EMBODIMENTS

Figure 1:
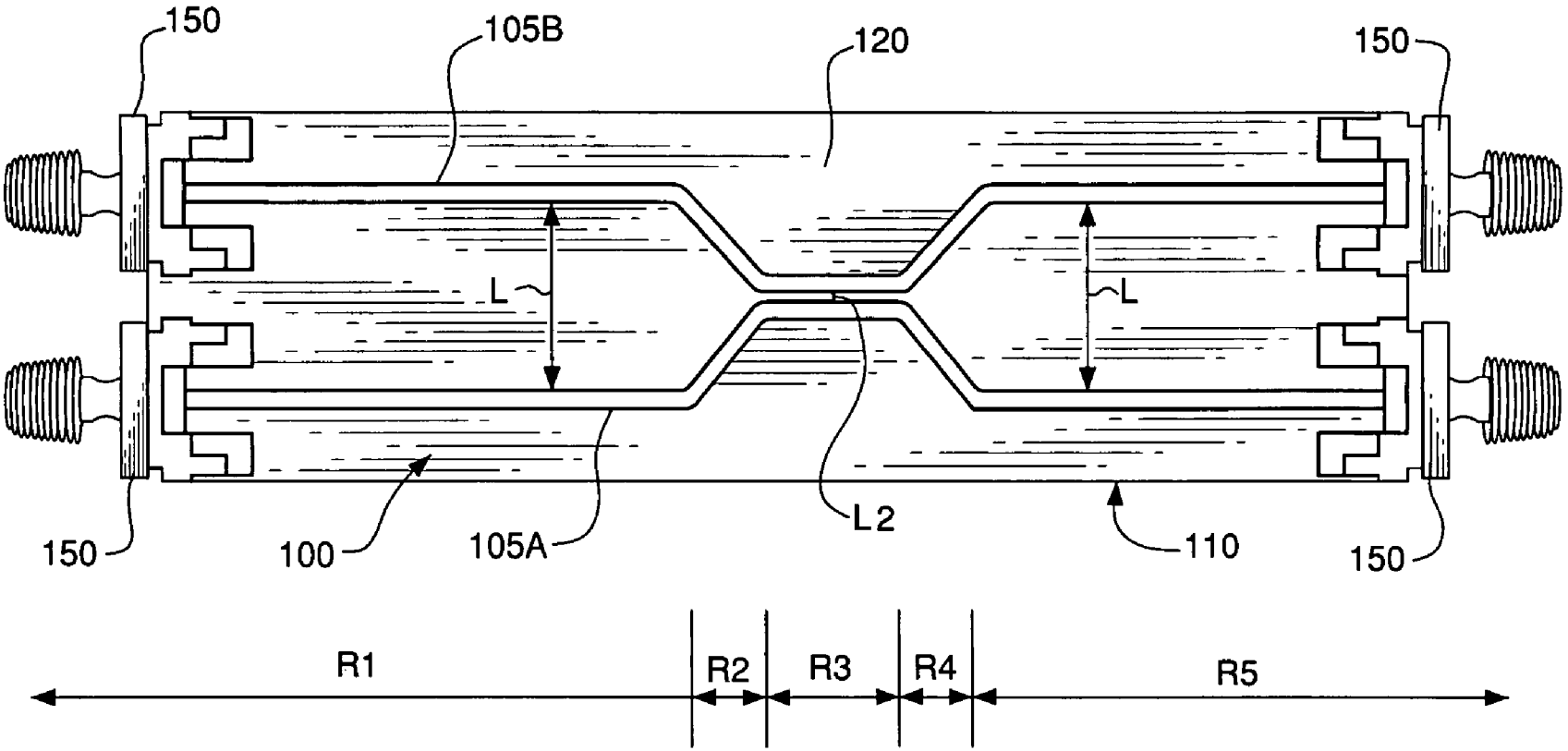
FIG. 1 depicts an example of a differential signal pair in an electrical connector having a ground connection adapted to connect the ground reference of a first electrical device with the ground reference of a second electrical device.

FIG. 1 depicts an example of a differential signal pair in an electrical connector having a ground connection adapted to connect the ground reference of a first electrical device with the ground reference of a second electrical device. Particularly, FIG. 1 shows a printed circuit board 110 having a differential signal pair 100 disposed thereon. Differential signal pair 100 comprises two signal contacts 105A and 105B, and is adjacent to a ground plane 120. As illustrated, the ground plane 120 extends from one end of the signal pair 105A and 105B to the other, and is adapted to connect the ground references of near-end and far-end electrical devices (not shown).

For description purposes, the board 110 may be divided into five regions R1-R5. In the first region, R1, respective SMA connectors 150 with threaded mounts connected thereto are attached to the respective ends of the signal contacts 105A and 105B. The SMA connectors in region R1 are used to electrically connect a signal generator (not shown) to the signal pair 100 such that a differential signal can be driven through the signal pair 100. In region R1, the two signal contacts 105A and 105B are separated by a distance L, with both contacts being adjacent to the ground plane 120. In region R1, the ground plane 120 helps to maintain the signal integrity of the signal passing through signal contacts 105A and 105B.

In the second region, R2, the signal contacts 105A and 105B jog together until they are separated by a distance L2. In region R3, the signal contacts 105A and 105B are positioned to simulate a differential pair of signal contacts as such contacts might be positioned relative to one another in a high-density, high-speed electrical connector.

In the fourth region, R4, the signal contacts 105A and 105B jog apart until separated by a distance L. In region R5, the two signal contacts 105A and 105B are separated by a distance L, with both contacts 105A and 105B being adjacent to the ground plane 120. Also in region R5, respective SMA connectors 150 having threaded mounts connected thereto are attached to respective ends of the signal contacts 105A and 105B. The SMA connectors in region R5 are used to electrically connect the signal contacts 105A and 105B to a signal receiver (not shown) that receives the electrical signals passed through the signal pair 100. As shown in FIG. 1, the ground plane is present in all regions R1 through R5.

Figure 2:
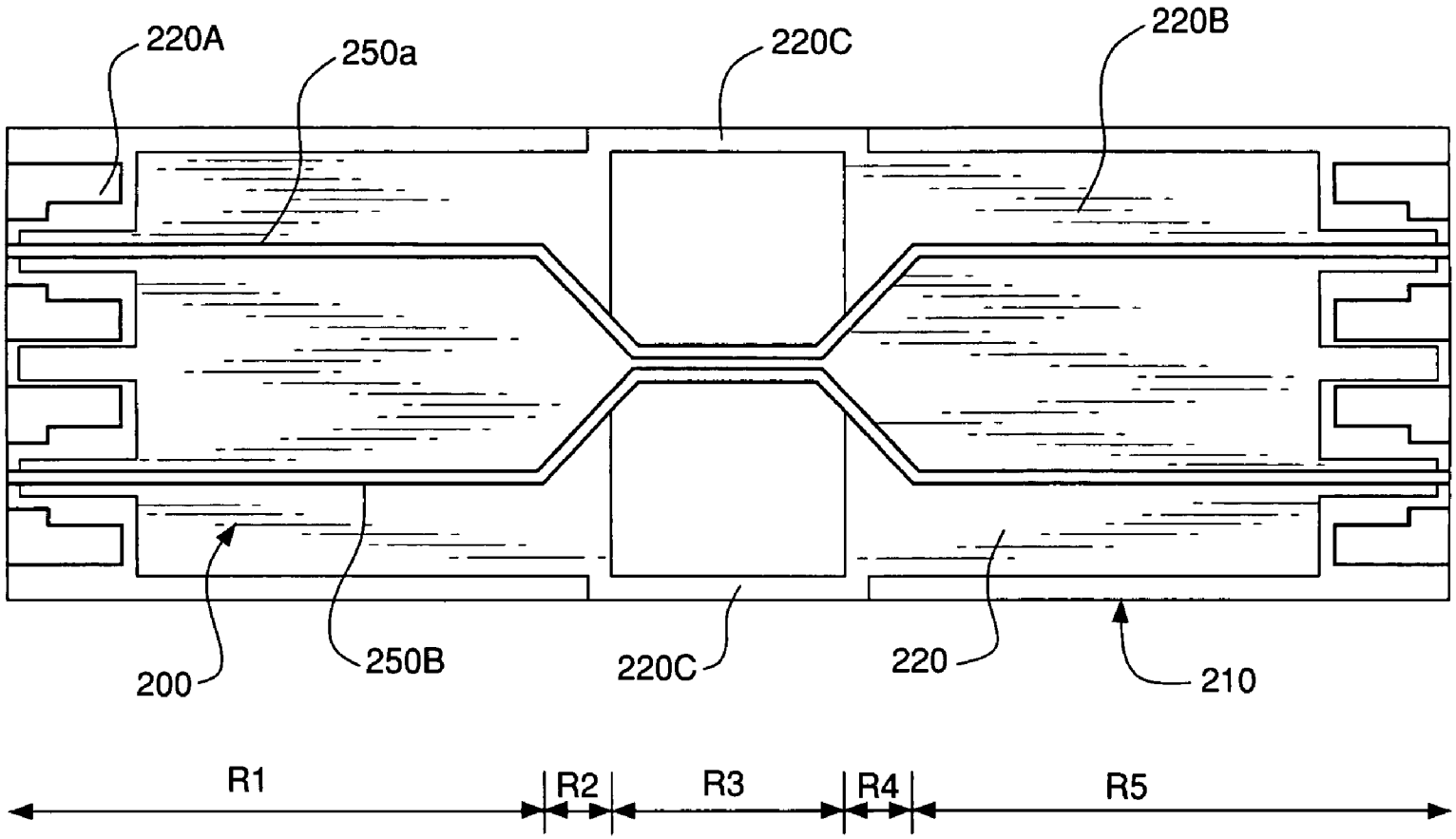
FIG. 2 depicts another example of a differential signal pair in an electrical connector having a ground connection adapted to connect the ground reference of a first electrical device with the ground reference of a second electrical device.

FIG. 2 illustrates another configuration of a ground plane on a printed circuit board that is adapted to connect the ground plane on one electrical device to the ground plane on another electrical device. FIG. 2 shows a printed circuit board 210 having a differential signal pair 200 thereon. Differential signal pair 200 comprises two signal contacts 250A and 250B. Though not shown in FIG. 2, respective SMA connectors were attached for test purposes to the ends of the signal contacts 250A and 250B.

The printed circuit board 210 contains a ground plane 220. The ground plane 220 is illustrated as the darker region on the printed circuit board 210. Thus, as shown, the ground plane 220 is not adjacent to the signal contacts 250A and 250B along their entire lengths.

The ground plane 220 comprises three portions 220A, 220B, and 220C. In portions 220A and 220B, the ground plane is adjacent to the signal contacts 250A and 250B. Ground plane portion 220C is not adjacent to the signal contacts 250A and 250B. In this manner, the lack of a ground adjacent to signal contacts 250A and 250B simulates a high speed electrical connector that lacks a ground contact adjacent to the pair of signal contacts 250A and 250B.

As shown in FIG. 2, ground plane portion 220C connects ground plane portions 220A and 220B. In this manner, though not adjacent to signal contacts 250A and 250B in region R3, the ground plane 220 extends along the entire length L of the circuit board 210, and is adapted to connect the ground references of near-end and far-end electrical devices.

Figure 3:
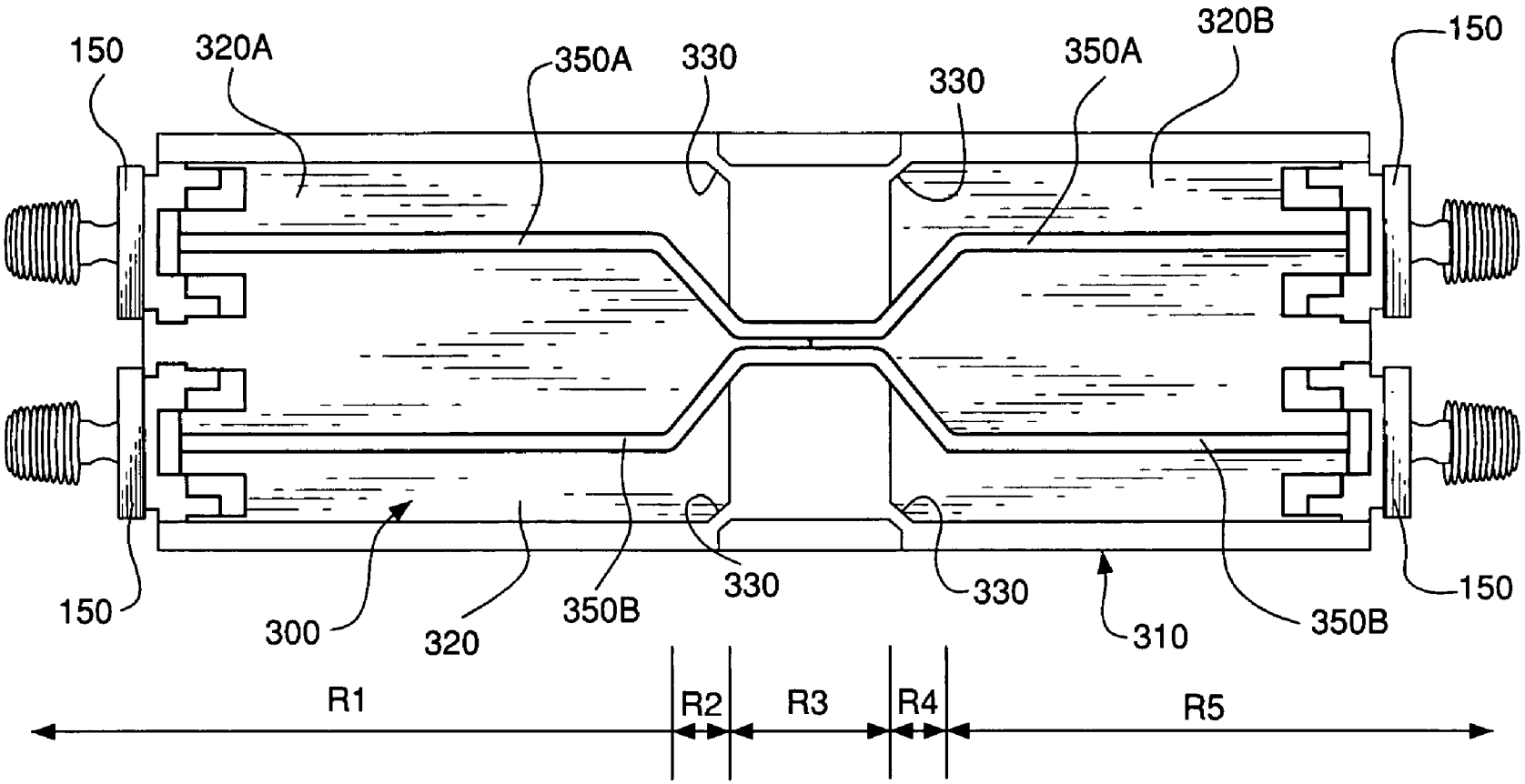
FIG. 3 depicts a differential signal pair in an electrical connector that is devoid of any ground connection adapted to connect the ground reference of a first electrical device with the ground reference of a second electrical device.

FIG. 3 depicts a differential signal pair 300 in an electrical connector that is devoid of any ground connection adapted to connect the ground reference of a first electrical device with the ground reference of a second electrical device. As shown, the differential signal pair 300 is disposed on a printed circuit board 310 and comprises two signal contacts 350A and 350B. Each end of signal contacts 350A and 350B has a respective SMA connector 150 with a threaded mount connected thereto to connect the signal pair 300 between a signal generator (not shown) and a signal receiver (not shown). The printed circuit board 310 contains a ground plane 320, which is illustrated as the darker region on printed circuit board 310. As shown, the ground plane 320 comprises two regions 320A and 320B. In portions 320A and 320B, the ground plane is adjacent the signal contacts 350A and 350B.

By contrast with the differential signal pair 200 on printed circuit 210 of FIG. 2, there is no ground plane that connects ground portions 320A and 320B. That is, as shown in FIG. 3, the ground planes are severed at points 330, thereby eliminating any ground connection that connects the near-end ground reference to the far-end ground reference. In other words, the connector depicted in FIG. 3 is a high speed electrical connector that is devoid of any ground connection between the ground reference of a first electrical device connected to the connector and the ground reference of a second electrical device connected to the connector. Further, the connector depicted in FIG. 3 is devoid of any ground contacts adjacent to the signal contacts.

The electrical connectors depicted in FIGS. 2 and 3 were subject to a number of tests to determine whether the removal of ground connection between the ground reference of one electrical device and the ground reference of another electrical device affected the signal integrity of a high-speed signal passing through the differential signal pair. In other words, a high-speed electrical connector that was devoid of any ground connections between the ground on a near-end electrical device and the ground on a far-end electrical device was tested to see whether the connector was suitable for impedance-controlled, high-speed, low-interference communications.

For testing purposes, a test signal was generated in a signal generator (not shown) that was connected to the end of each of the signal contacts in region R1 of boards 110, 210 and 310.

A signal receiver (not shown) was attached to the other end of signal contacts in region R5 of boards 110, 210, and 310. A test signal was then driven through boards 110, 210, and 310 to determine whether the signal receiver received the generated signal without significant loss.

Figure 4A:
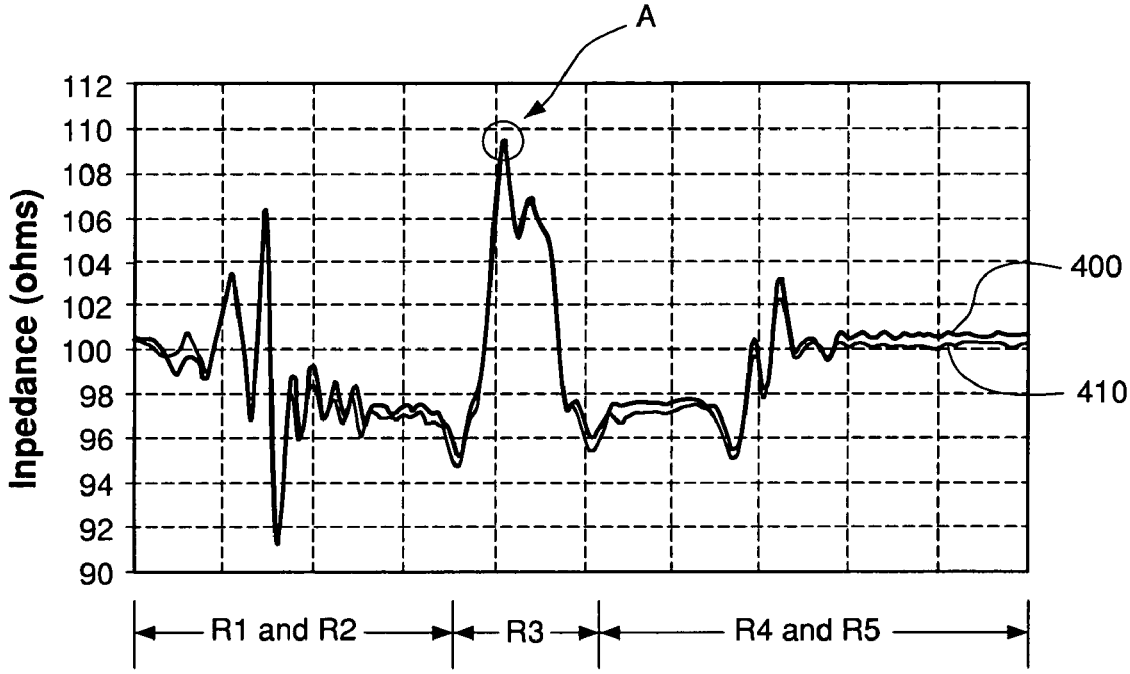
FIGS. 4A-C illustrate differential impedance test results as performed on the differential signal pairs of FIGS. 2 and 3, respectively.
Figure 4B:
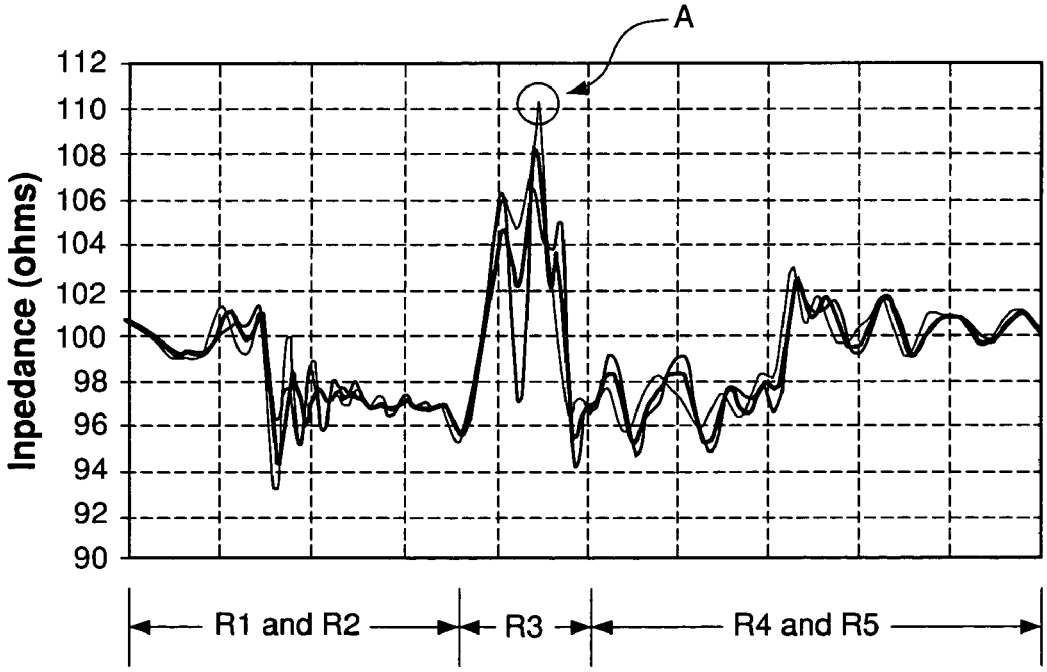
Figure 4C:
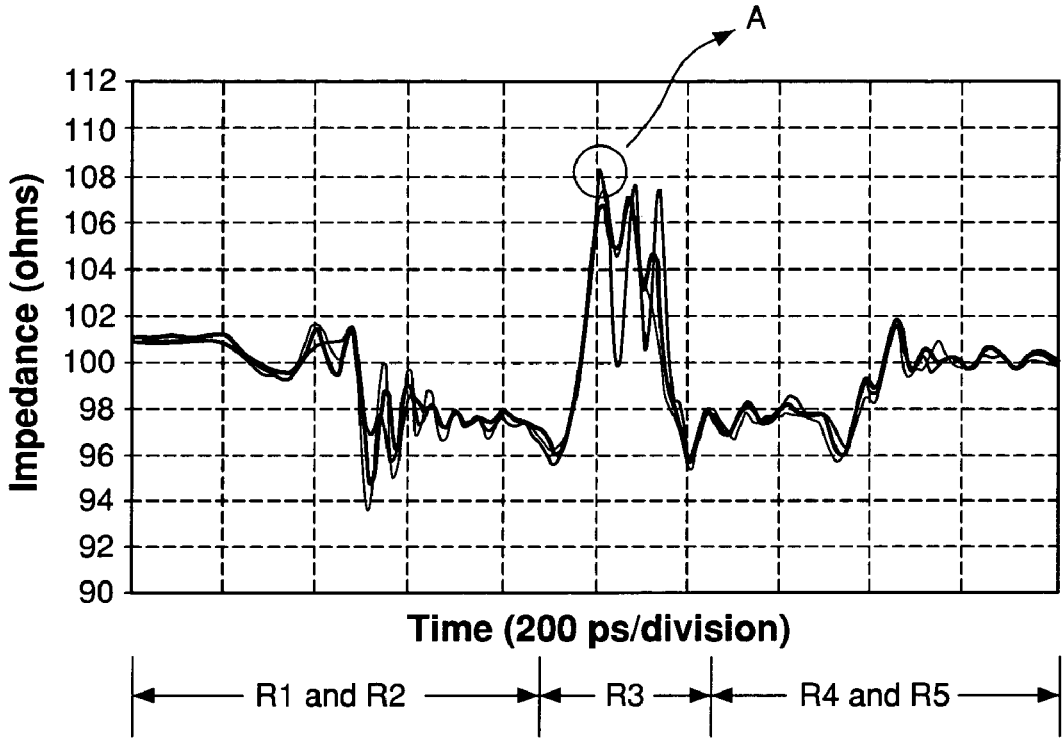

Impedance tests were performed on the differential signal pairs of FIGS. 2 and 3. Specifically, impedance tests were conducted to determine whether the removal of a continuous ground from the near end of the connector to the far end of the connector adversely affected the impedance. FIGS. 4A-C illustrate various differential impedance test results as performed on the differential signal pairs of FIGS. 2 and 3. It should be appreciated that as the data points in the graphs move from left to right along the x-axis (time), the data points depict the impedance of the signal pair as the signal moves sequentially through regions R1-R5 of the tested boards.

FIG. 4A shows the differential impedance test results as performed on the differential signal pairs of FIGS. 2 and 3, respectively. As shown, differential impedance, illustrated along the y-axis, was measured in ohms. Time, illustrated along the x-axis, was scaled to 200-ps divisions.

The differential impedance test results for the differential signal pair 200 is represented by the line 400 in graph FIG. 4A. The differential impedance test results for the differential signal pair 300 is represented by the line 410. It is clear that the test results for the two differential signal pairs 200 and 300 are substantially the same. In fact, from viewing the test results when the test signal passed through R3 on board 310 (i.e. the board or electrical connector having no connection between the grounds on the electrical devices), the greatest deviation from the controlled impedance of 100 ohms was roughly 109.5 ohms at point A. It should be appreciated that in FIG. 4A the impedance of differential signal pair 300, despite lacking a ground connection that connected the grounds of the electrical devices attached to the board, remained within the industry standard deviation of 10%.

In accordance with another aspect of the present invention, the differential impedance of the signal pair 300 may be adjusted by widening the traces of the differential signal pair. Consequently, the width of the signal traces and the resulting impedance of the differential signal pair may be customized to suit the consumer's specific application and specification for the connector. Additionally, the impedance of the differential signal pair may also be adjusted by moving the signal traces closer together or farther apart. The distance between the signal traces and the resulting impedance may be customized to suit a consumer's specific application and specification for the connector.

FIG. 4B illustrates the measured impedance of differential signal pair 200 after introducing various degrees of skew. Specifically, skews of 0-20 ps were introduced and the impedance of differential signal pair 200 was measured at each level of introduced skew. In fact, from viewing the test results when the test signal passed through R3 on board 210 (i.e. the board or electrical connector having no ground adjacent to the signal pair), the greatest deviation of the controlled impedance of 100 ohms was roughly 110 ohms at point A. It should be appreciated that at all times the impedance of differential signal pair 200 remained within the industry standard deviation of 10%.

FIG. 4C illustrates the measured impedance of differential signal pair 300 after introducing various degrees of skew. Specifically, skews of 0-20 ps were introduced and the impedance of differential signal pair 300 was measured at each level of introduced skew. In fact, from viewing the test results when the test signal was passed through R3 on board 310 (i.e., the board or electrical connector having no ground connection between the grounds on the electrical devices), the greatest deviation of the controlled impedance of 100 ohms was roughly 108 ohms at point A. It should be appreciated that at all times the impedance of differential signal pair 300 remained within the industry standard deviation of 10%.

By comparison of the plots provided in FIGS. 4B and 4C, it may be understood that, even without any ground connection connecting the ground reference of a near-end electrical device with the ground reference of a far-end electrical device, the differential impedance between the connectors that form the signal pair remained within accepted industry standards.

Figure 5:
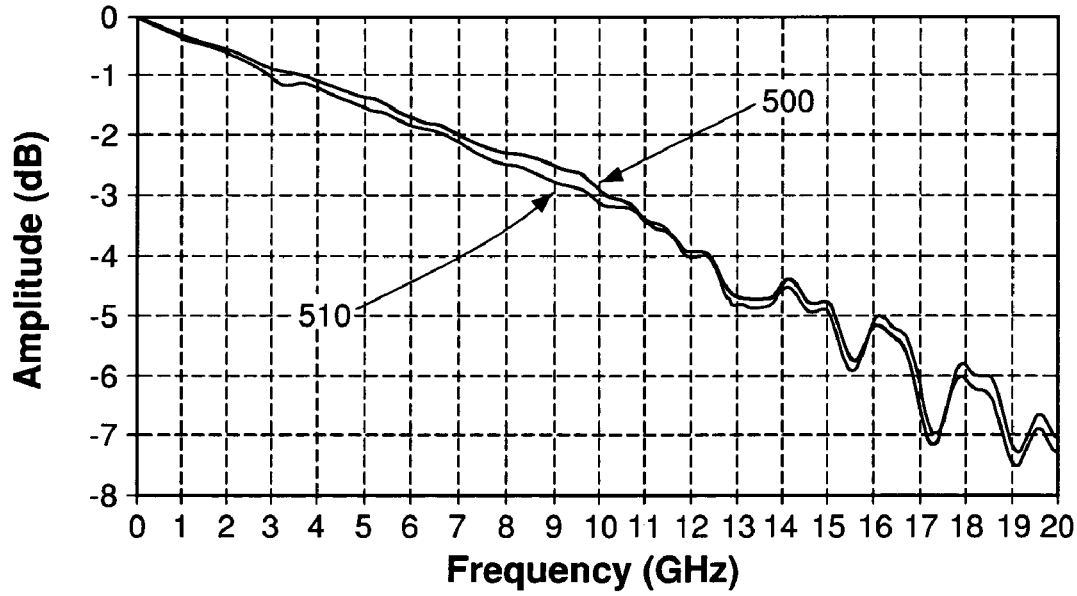
FIG. 5 illustrates differential insertion loss tests results as performed on the differential signal pairs of FIGS. 2 and 3, respectively.

FIG. 5 illustrates differential insertion loss test results as performed on the differential signal pair of FIGS. 2 and 3, respectively. As shown, the differential insertion loss test results for differential signal pair 200 are represented by the line 500. The differential insertion loss test results for differential signal pair 300 are represented by the line 510. It is clear that the test results for the two differential signal pairs 200 and 300 are substantially the same. Particularly, the 3 dB point, which represents the point at which 50% of the power has been lost, occurs at roughly 10 Ghz for both differential signal pair 200 and for differential signal pair 300.

Figure 6A:
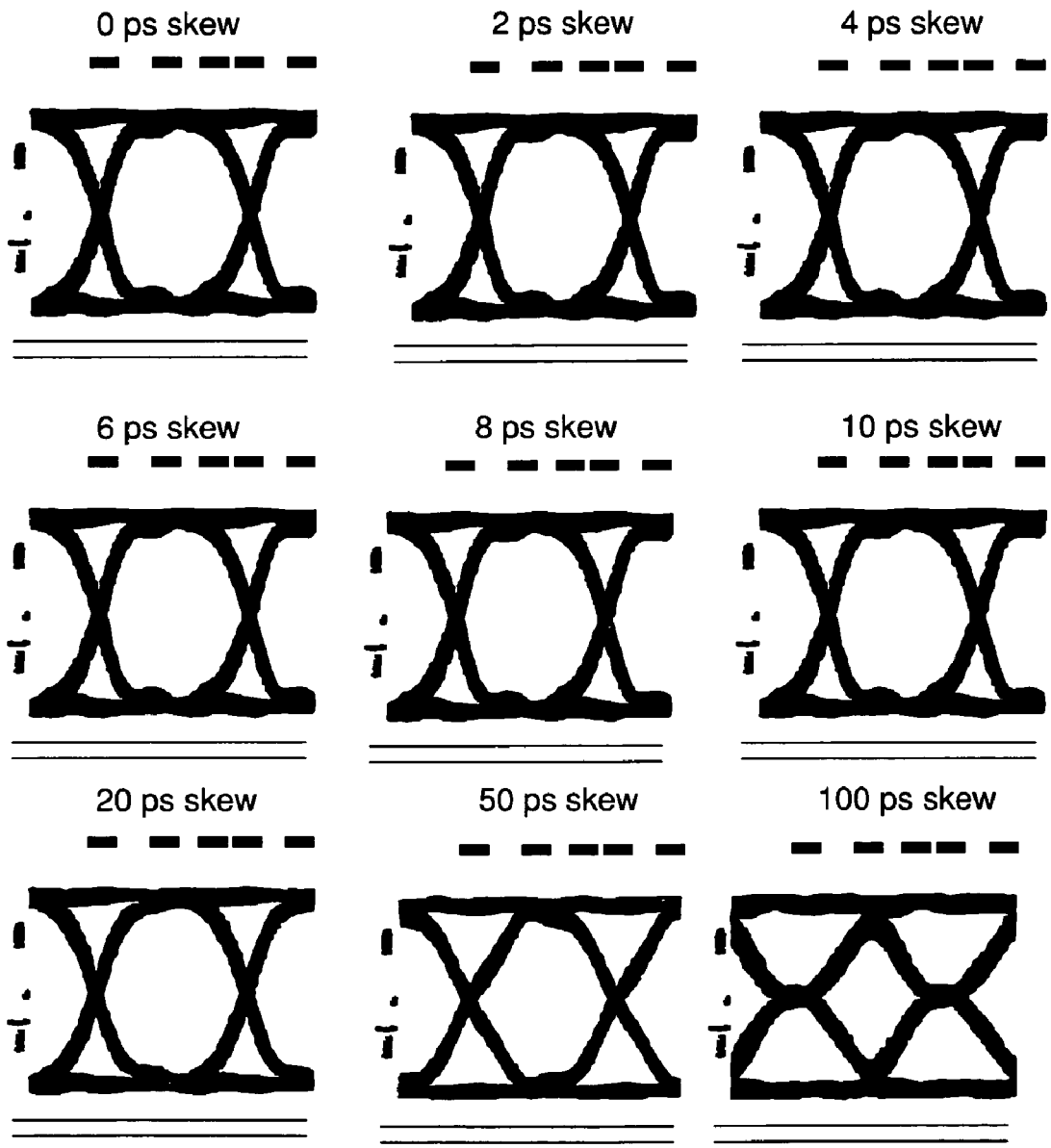
FIG. 6A illustrates eye pattern test results using a 6.25 Gb/s test signal as performed on the differential signal pair of FIG. 3.
Figure 6B:
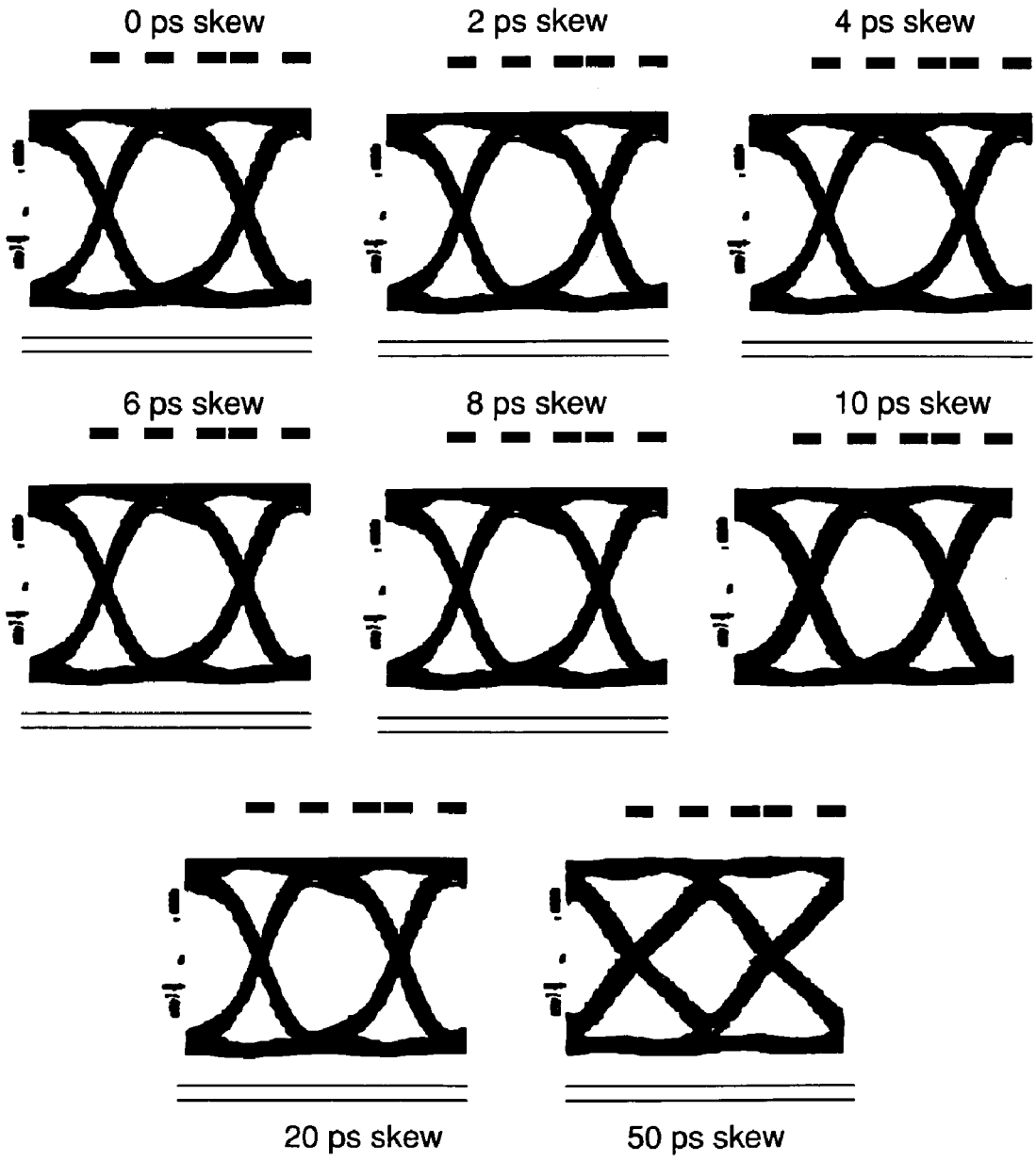
FIG. 6B illustrates eye pattern test results using a 10 Gb/s test signal as performed on the differential signal pair of FIG. 3.

FIGS. 6A and 6B show the results of the eye pattern testing performed on the differential pair 300 of FIG. 3. Eye pattern testing is used to measure signal integrity as a result of various causes of signal degradation including, for example, reflection, radiation, cross talk, loss, attenuation, and jitter. Specifically, in eye pattern testing, sequential square wave signals are sent through a transmission path from a transmitter to a receiver. In the present case, sequential square waves were sent through the signal contacts of boards 110, 210, and 310. In a perfect transmission path (one with no loss), the received signal will be an exact replica of the transmitted square wave. However, because loss is inevitable, loss causes the square wave to morph into an image that is similar to a human eye, hence the term eye pattern testing. Specifically, the corners of the square wave become rounder and less like a right angle.

In terms of signal integrity, a signal has better integrity as the eye pattern becomes wider and taller. As the signal suffers from loss or attenuation, the vertical height of the eye becomes shorter. As the signal suffers from jitter caused for example by skew, the horizontal width of the eye becomes less. The height and width of the eye may be measured by building a mask in the interior of the eye. A mask may be a rectangle having its four corners tangent to the created eye pattern. The dimensions of the mask may then be calculated to determine the signal integrity of the transmitted signal.

As illustrated in FIG. 6A, eye pattern testing was performed at 6.25 Gb/s on the differential signal pair 300 of FIG. 3 with introduced skew of 0 ps, 2 ps, 4 ps, 6 ps, 8 ps, 10 ps, 20 ps, 50 ps, and 100 ps. Prior to testing, it was believed that by removing the continuous ground from printed circuit board 120 (or a high speed connector) and introducing various levels of skew with a test signal of 6.25 Gb/s, the resulting eye pattern would be unacceptable and such signal transmission configuration unsuitable for use in a high speed electrical connector. As shown in FIG. 6A, the eye pattern test results are considered commercially acceptable for certain applications.

As illustrated in FIG. 6B, eye pattern testing was performed at 10 Gb/s on the differential signal pair 300 of FIG. 3 with introduced skew of 0 ps, 2 ps, 4 ps, 6 ps, 8 ps, 10 ps, 20 ps, and 50 ps. Prior to testing, it was believed that by removing the continuous ground from printed circuit board 120 (or a high speed connector) and introducing various levels of skew with a test signal of 10 Gb/s, the resulting eye pattern would be unacceptable and such signal transmission configuration unsuitable for use in a high speed electrical connector. As shown in FIG. 6B, the eye pattern test results are considered commercially acceptable for certain applications.

FIGS. 7A and 7B are tables that quantitatively show the results of the eye pattern testing as performed on differential signal pair 300. FIG. 7A shows jitter measurements from signal pair 300 when test signals of 6.25 Gb/s and 10 Gb/s were passed therethrough. Jitter is determined by measuring the horizontal dimension of the mask in the eye pattern. As shown in FIG. 7A, when 200 ps of skew was introduced in signal pair 300 at 6.25 Gb/s, the resulting jitter could not be measured. In other words, too much skew rendered the eye pattern unreadable. Also, when 100 ps and 200 ps of skew was introduced in signal pair 300 at 10 Gb/s, the resulting jitter could not be measured because of too much skew.

FIG. 7B shows the eye height taken at 40% of the unit interval of the signal pair 300 when test signals of 6.25 Gb/s and 10 Gb/s were passed therethrough. As shown in FIG. 7B, when 200 ps of skew was introduced in pair 300 at 6.25 Gb/s, the eye height and jitter could not be measured because of too much skew. Also, when 100 ps and 200 ps of skew was introduced in pair 300 at 10 Gb/s, the eye height could not be measured because of too much skew.

Figure 8A:
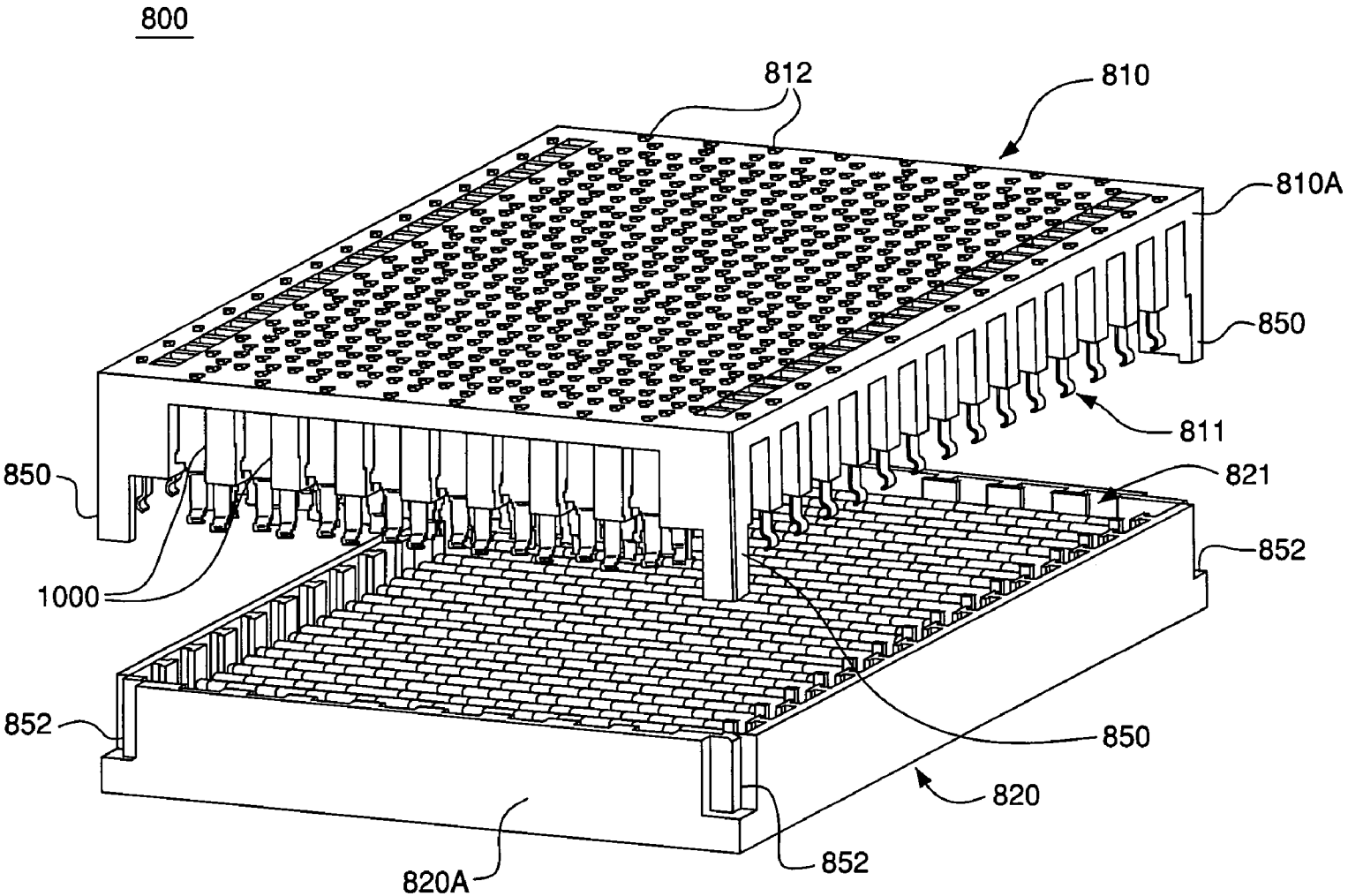
FIG. 8A is a perspective view of a typical mezzanine-style electrical connector.

FIG. 8A depicts a typical mezzanine-style connector assembly. It will be appreciated that a mezzanine connector is a high-density stacking connector used for parallel connection of one electrical device such as, a printed circuit board, to another electrical device, such as another printed circuit board or the like. The mezzanine connector assembly 800 illustrated in FIG. 8A comprises a receptacle 810 and header 820.

In this manner, an electrical device may electrically mate with receptacle portion 810 via apertures 812. Another electrical device may electrically mate with header portion 820 via ball contacts. Consequently, once header portion 820 and receptacle portion 810 of connector 800 are electrically mated, the two electrical devices that are connected to the header and receptacle are also electrically mated via mezzanine connector 800. It should be appreciated that the electrical devices can mate with the connector 800 in any number of ways without departing from the principles of the present invention.

Receptacle 810 may include a receptacle housing 810A and a plurality of receptacle grounds 811 arranged around the perimeter of the receptacle housing 810A, and header 820 may include a header housing 820A and a plurality of header grounds 821 arranged around the perimeter of the header housing 820A. The receptacle housing 810A and the header housing 820A may be made of any commercially suitable insulating material. The header grounds 821 and the receptacle grounds 811 serve to connect the ground reference of an electrical device that is connected to the header 820 to the ground reference of an electrical device that is connected to the receptacle 810. The header 820 also contains header IMLAs (not individually labeled in FIG. 8A for clarity) and the receptacle 810 contains receptacle IMLAs 1000.

Receptacle connector 810 may contain alignment pins 850. Alignment pins 850 mate with alignment sockets 852 found in header 820. The alignment pins 820 and alignment sockets 852 serve to align the header 820 and the receptacle 810 during mating. Further, the alignment pins 820 and alignment sockets 852 serve to reduce any lateral movement that may occur once the header 820 and receptacle 810 are mated. It should be appreciated that numerous ways to connect the header portion 820 and receptacle portion 810 may be used without departing from the principles of the invention.

Figure 8B:
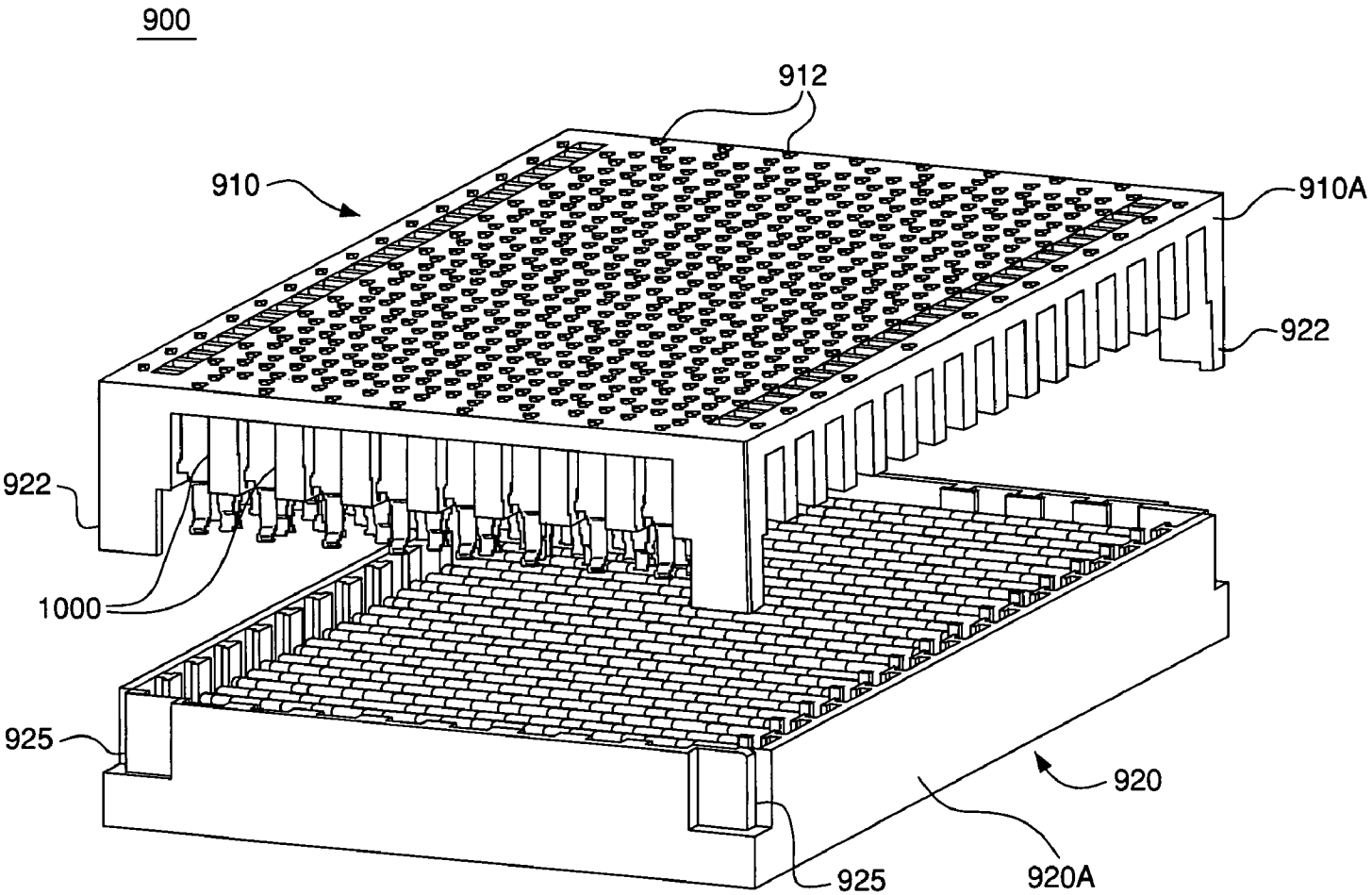
FIG. 8B is a perspective view of an exemplary mezzanine-style electrical connector having a header portion and a receptacle portion in accordance with an embodiment of the invention.

FIG. 8B is a perspective view of an electrical connector in accordance with an embodiment of the invention. As shown, the connector 900 may have a receptacle portion 910 and a header portion 920. Receptacle 910 may include a receptacle housing 910A and header 920 may include a header housing 920A. Unlike the connector 800 depicted in FIG. 8A, the connector 900 depicted in FIG. 8B may be devoid of header grounds arranged around the perimeter of the header housing 920A and of receptacle grounds arranged around the perimeter of the receptacle housing 910A.

An electrical device may electrically mate with the receptacle portion 910 via apertures 912. Another electrical device may electrically mate with the header portion 920 via ball contacts, for example. Consequently, once header portion 920 and receptacle portion 910 of connector 900 are electrically mated, the two electrical devices are electrically mated via connector 900. It should be appreciated that the electrical devices can mate with the connector 900 in any number of ways without departing from the principles of the present invention.

The header 920 also contains header IMLAs (not individually labeled in FIG. 8B for clarity) and the receptacle 910 contains receptacle IMLAs 1000. It will be appreciated that the receptacle 910 and header 920 can be mated to operatively connect the receptacle and header IMLAs. For example, and in one embodiment of the invention, protrusions 922 in the corners of receptacle 910 may aid the connection between the receptacle 910 and the header 920. In this manner, protrusions 922 may be adapted to create in interference fit with complementary recesses 925 in the header portion 920 of the connector 900. It should be appreciated that numerous ways to connect the header portion 920 and receptacle portion 910 may be used without departing from the principles of the invention.

In accordance with one embodiment of the invention, the connector 900 is devoid of any ground connections that connect the header portion 920 to the receptacle portion 910. In this manner, the receptacle 910 and the header 910 of the high speed connector is devoid of any ground that would connect the ground reference of a first electrical device connected to the connector to the ground reference of a second electrical device connected to the connector. That is, the electrical connector 900 is devoid of any ground connections that electrically connect the ground references of the electrical devices electrically connected to the receptacle portion 910 and the header portion 920 of connector 900. As should be appreciated, the ground references of the electrical devices may be referred to as the near-end and far-end ground planes.

Figure 9:
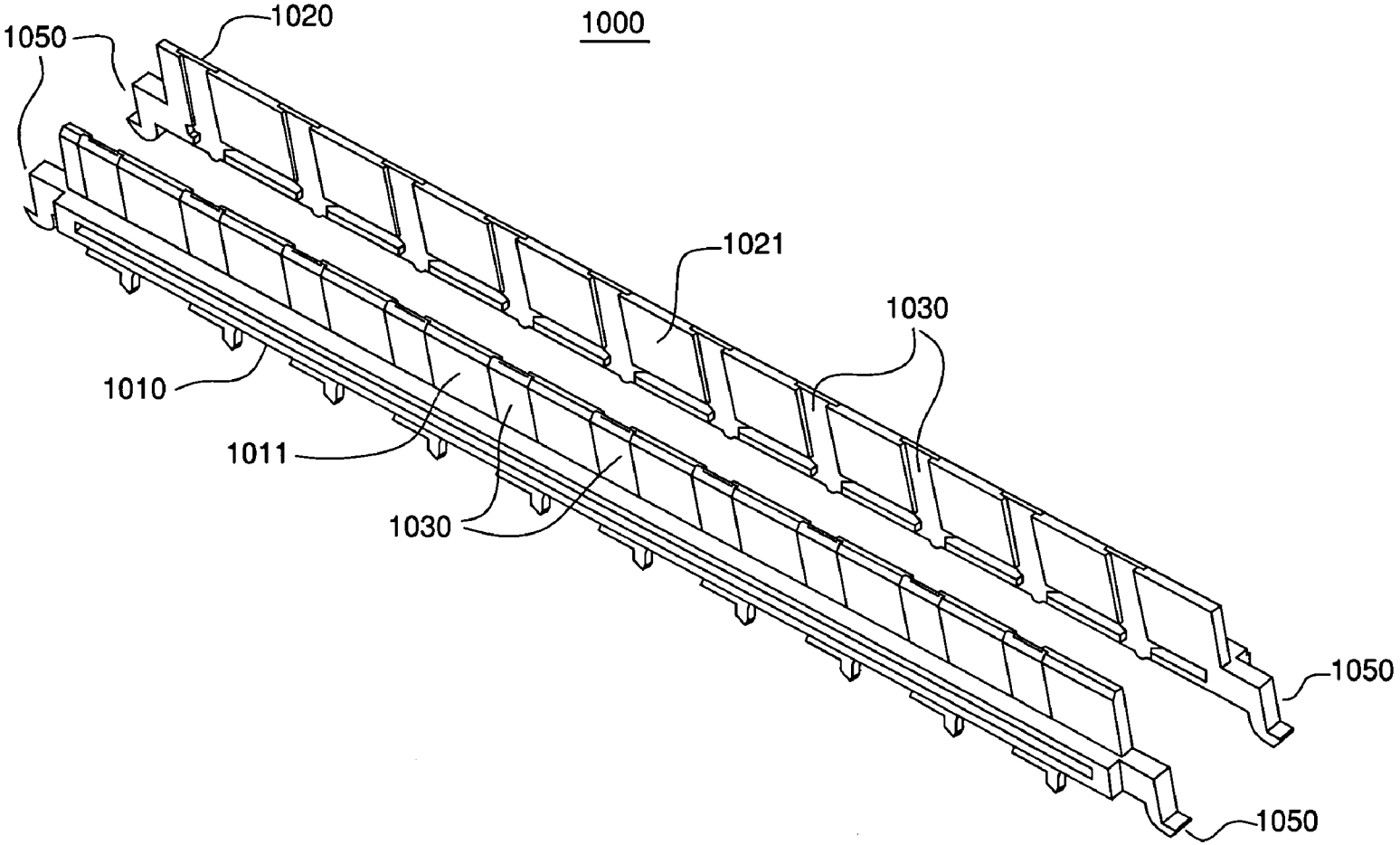
FIG. 9 is a perspective view of a header insert molded lead assembly pair in accordance with an embodiment of the invention.

FIG. 9 is a perspective view of a header insert molded lead assembly pair that may be used in a high speed connector in accordance with an embodiment of the invention. In FIG. 9, the header IMLA pair 1000 comprises a header IMLA A 1010 and a header IMLA B 1020. IMLA A 1010 comprises an overmolded housing 1011 and a series of header contacts 1030, and header IMLA B 1020 comprises an overmolded housing 1021 and a series of header contacts 1030. As can be seen in FIG. 9, the header contacts 1030 are recessed into the housings of header IMLAs 1010 and B 1020. It should be appreciated that header IMLA pair 1000 may contain only signal contacts with no ground contacts or connections contained therein.

IMLA housing 1011 and 1021 may also include a latched tail 1050. Latched tail 1050 may be used to securely connect IMLA housing 1011 and 1021 in header portion 820 of mezzanine connector 800. It should be appreciated that any method of securing the IMLA pairs to the header 820 may be employed.

Figure 10:
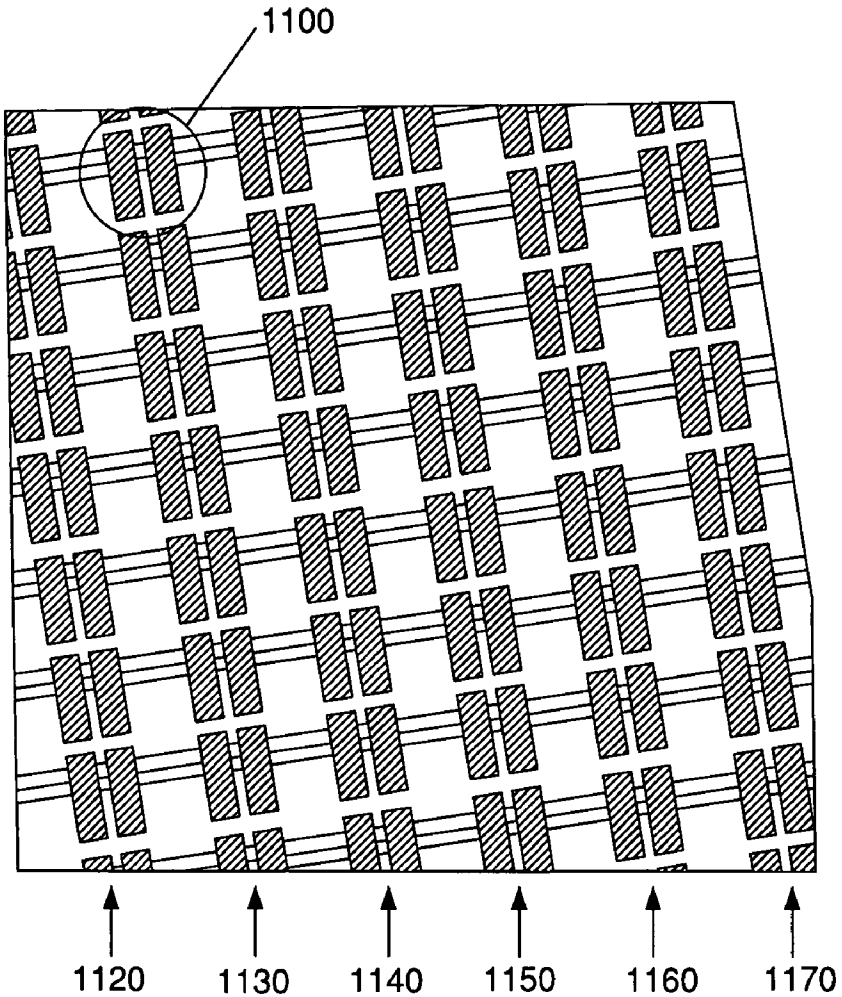
FIG. 10 is a top view of a plurality of header assembly pairs in accordance with an embodiment of the invention.

FIG. 10 is a top view of a plurality of header assembly pairs in accordance with an embodiment of the invention. In FIG. 10, a plurality of header signal pairs 1100 are shown. Specifically, the header signal pairs are aligned in six columns or arranged in six linear arrays 1120, 1130, 1140, 1150, 1160 and 1170. It should be appreciated that, as shown and in one embodiment of the invention, the header signal pairs are aligned and not staggered in relation to one another. It should also be appreciated that, as described above, the header assembly need not contain any ground contacts.

Figure 11:
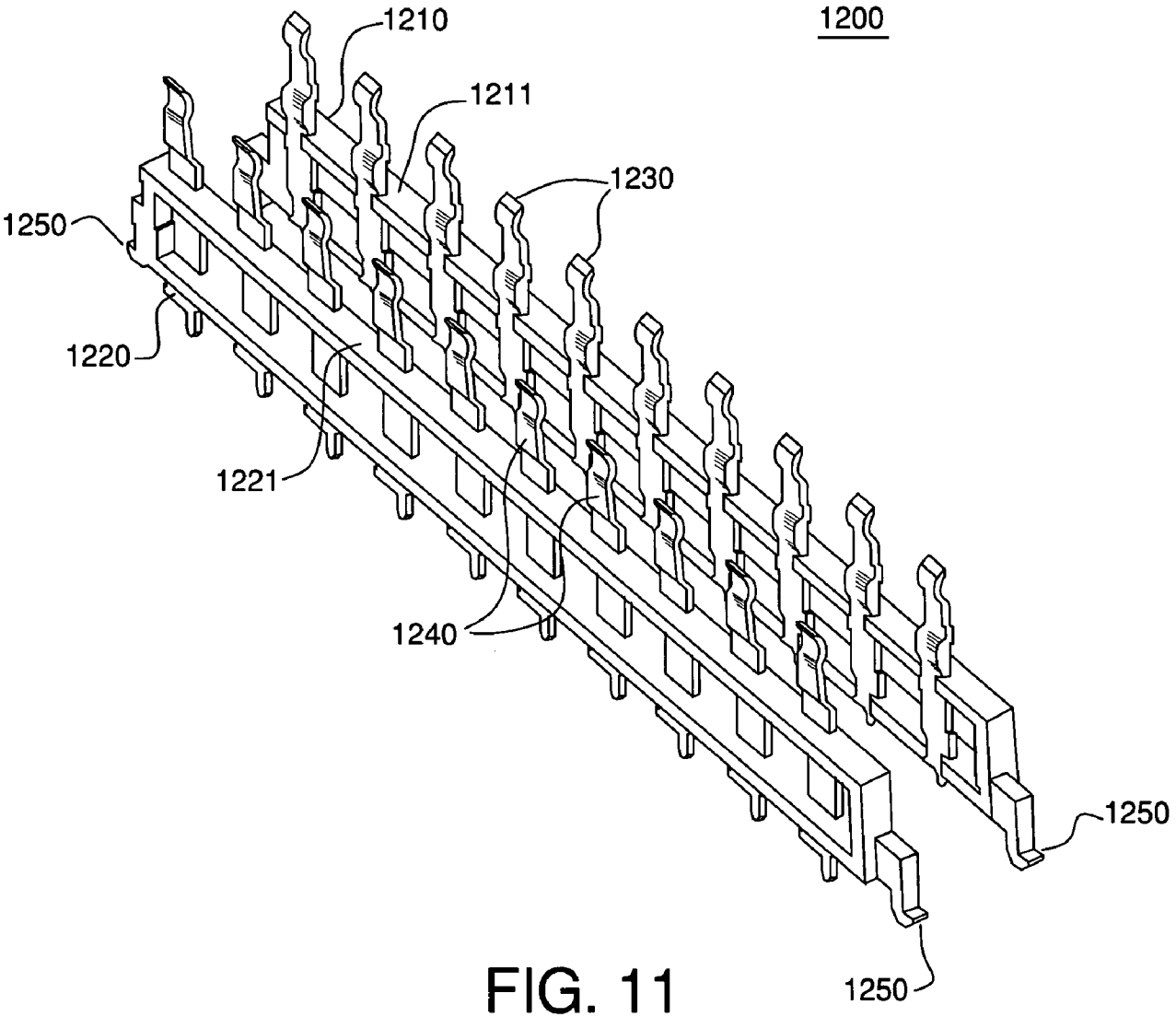
FIG. 11 is a perspective view of a receptacle insert molded lead assembly pair in accordance with an embodiment of the invention.

FIG. 11 is a perspective view of a receptacle insert molded lead assembly pair in accordance with an embodiment of the invention. Receptacle IMLA pair 1200 comprises receptacle IMLA 1210 and receptacle IMLA 1220. Receptacle IMLA 1210 comprises an overmolded housing 1211 and a series of receptacle contacts 1230, and a receptacle IMLA 1220 comprises an overmolded housing 1221 and a series of receptacle contacts 1240. As can be seen in FIG. 11, the receptacle contacts 1240, 1230 are recessed into the housings of receptacle IMLAs 1210 and 1220. It will be appreciated that fabrication techniques permit the recesses in each portion of the IMLA 1210, 1220 to be sized very precisely. In accordance with one embodiment of the invention, the receptacle IMLA pair 1200 may be devoid of any ground contacts.

IMLA housing 1211 and 1221 may also include a latched tail 1250. Latched tail 1250 may be used to securely connect IMLA housing 1211 and 1221 in receptacle portion 910 of connector 900. It should be appreciated that any method of securing the IMLA pairs to the header 920 may be employed.

Figure 12:
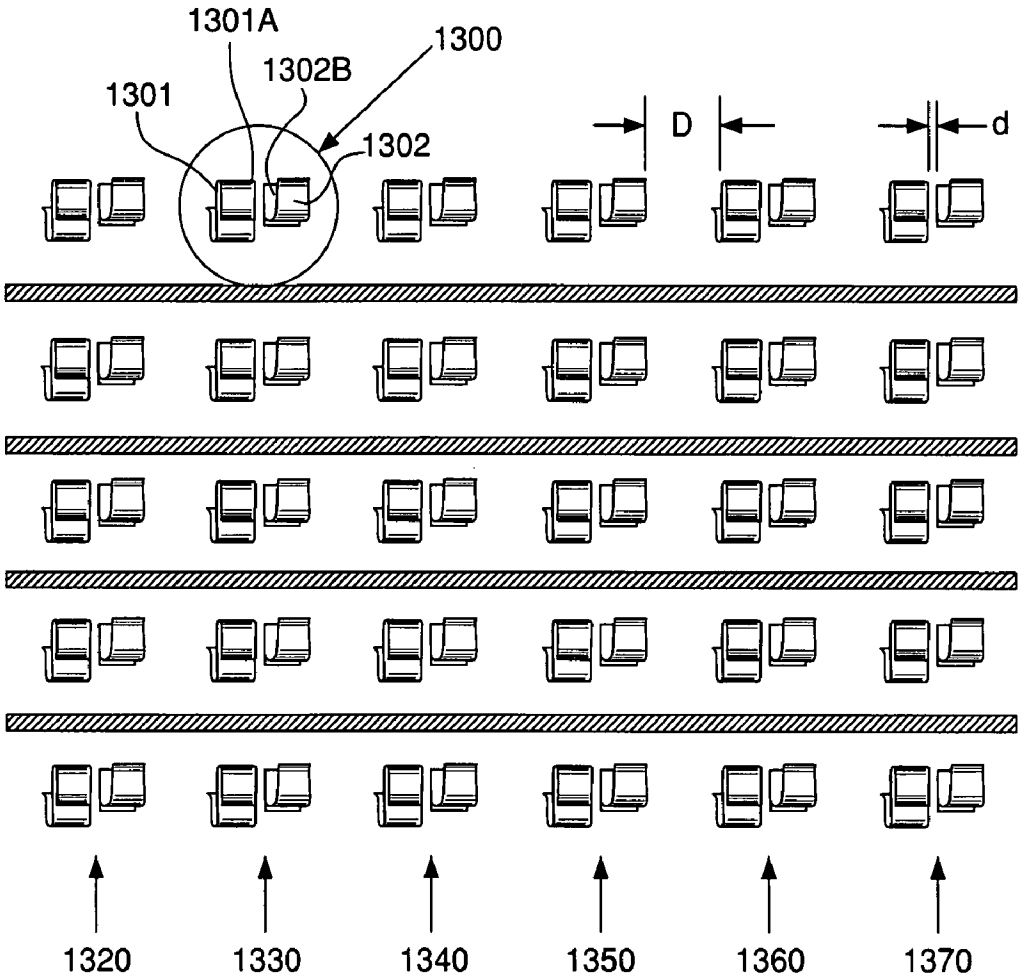
FIG. 12 is a top view of a plurality of receptacle assembly pairs in accordance with an embodiment of the invention.

FIG. 12 is a top view of a receptacle assembly in accordance with an embodiment of the invention. In FIG. 12, a plurality of receptacle signal pairs 1300 are shown. Receptacle pair 1300 comprises signal contacts 1301 and 1302. Specifically, the receptacle signal pairs 1300 are aligned in six columns or arranged in six linear arrays 1320, 1330, 1340, 1350, 1360 and 1370. It should be appreciated that, as shown and in one embodiment of the invention, the receptacle signal pairs are aligned and not staggered in relation to one another. It should also be appreciated that, as described above, the header assembly need not contain any ground contacts or ground connections.

Also as shown in FIG. 12, the differential signal pairs are edge coupled. In other words, the edge 1301A of one contact 1301 is adjacent to the edge 1302A of an adjacent contact 1302B. Edge coupling also allows for smaller gap widths between adjacent connectors, and thus facilitates the achievement of desirable impedance levels in high contact density connectors without the need for contacts that are too small to perform adequately. Edge coupling also facilitates changing contact width, and therefore gap width, as the contact extends through dielectric regions, contact regions, etc.

As shown in FIG. 12, the distance D that separates the differential signal pairs relatively larger than the distance d, between the two signal contacts that make up a differential signal pair. Such relatively larger distance contributes to the decrease in the cross talk that may occur between the adjacent signal pairs.

Figure 13:
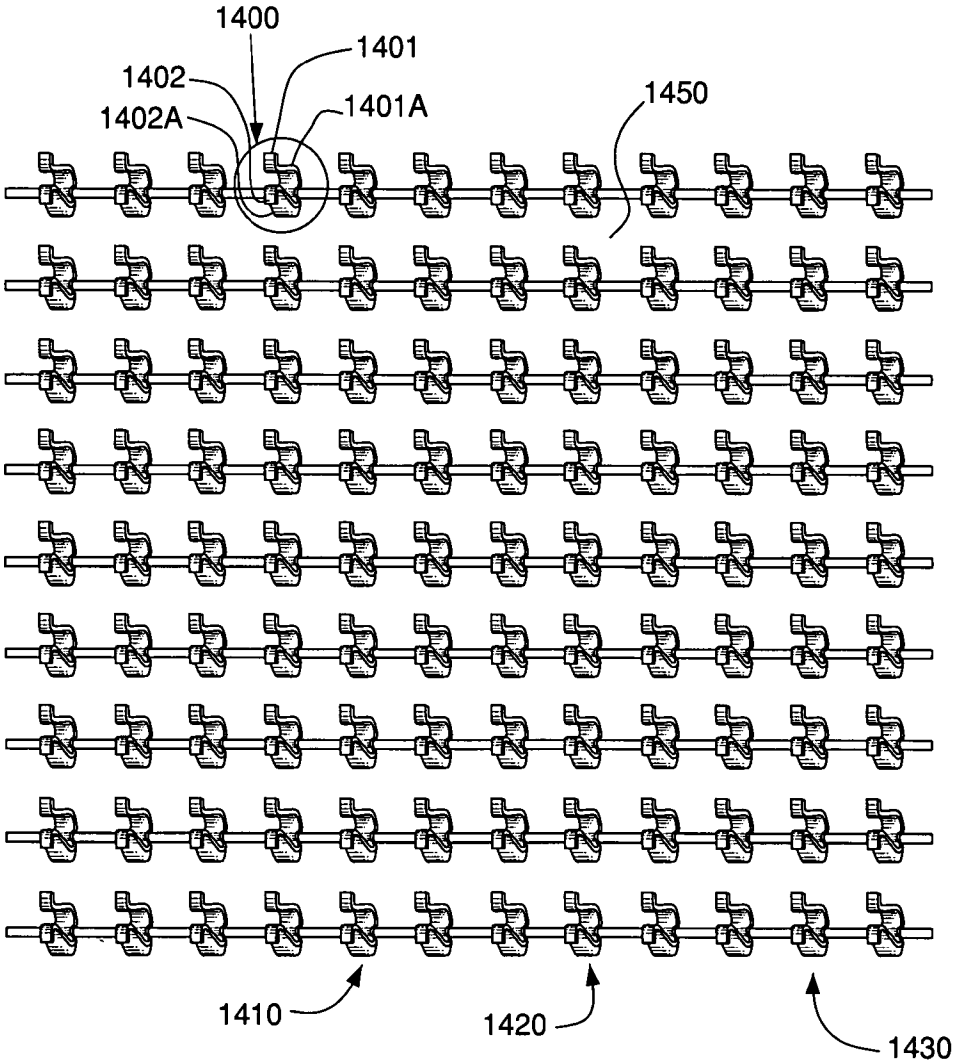
FIG. 13 is a top view of another plurality of receptacle assembly pairs in accordance with an embodiment of the invention.

FIG. 13 is a top view of another receptacle assembly in accordance with an embodiment of the invention. In FIG. 13, a plurality of receptacle signal pairs 1400 are shown. Receptacle signal pairs 1400 comprise signal contacts 1401 and 1402. As shown, the conductors in the receptacle portion are signal carrying conductors with no ground contacts present in the connector. Furthermore, signal pairs 1400 are broad-side coupled, i.e. where the broad side 1401A of one contact 1401 is adjacent to the broad side 1402A of an adjacent contact 1402 within the same pair 1400. The receptacle signal pairs 1400 are aligned in twelve columns or arranged in twelve linear arrays, such as, for example, 1410, 1420 and 1430. It should be appreciated that any number of arrays may be used.

In one embodiment of the invention, an air dielectric 1450 is present in the connector. Specifically, an air dielectric 1450 surrounds differential signal pairs 1400 and is between adjacent signal pairs. It should be appreciated that, as shown and in one embodiment of the invention, the receptacle signal pairs are aligned and not staggered in relation to one another.

Figure 14:
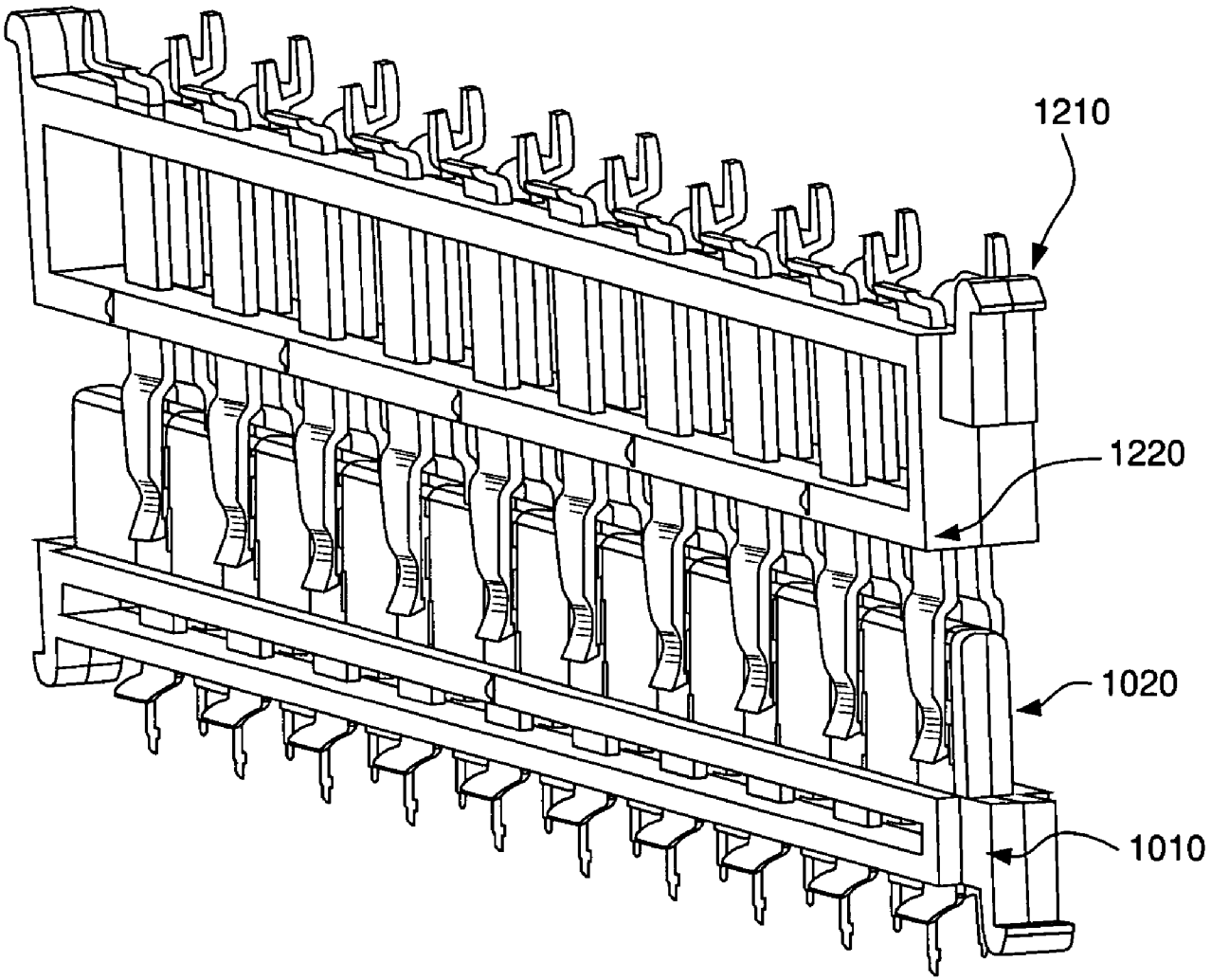
FIG. 14 is a perspective view of an operatively connected header and receptacle insert molded lead assembly pair in accordance with an embodiment of the invention.

FIG. 14 is a perspective view of a header and receptacle IMLA pair in accordance with an embodiment of the invention. In FIG. 14, a header and receptacle IMLA pair are in operative communications in accordance with an embodiment of the present invention. In FIG. 14, it can be seen that header IMLAs 1010 and 1020 are operatively coupled to form a single and complete header IMLA. Likewise, receptacle IMLAs 1210 and 1220 are operatively coupled to form a single and complete receptacle IMLA. FIG. 14 illustrates an interference fit between the contacts of the receptacle IMLA and the contacts of the header IMLA. It will be appreciated that any method of causing electrical contact, and/or for operatively coupling the header IMLA to the receptacle IMLA, is equally consistent with an embodiment of the present invention.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

The invention claimed is:

1. An electrical connector for connecting a first electrical device having a first ground reference to a second electrical device having a second ground reference, the electrical connector comprising:

a connector housing; and a first electrical contact and a second electrical contact, each received in the connector housing and carrying a respective electrical signal from the first electrical device to the second electrical device, wherein the electrical connector is devoid of any ground connection that electrically connects the first ground reference and the second ground reference, the first and second contacts form a differential signal pair, and each of the electrical signals has a data transfer rate of at least 1.0 gigabits/second.

2. The electrical connector of claim 1, wherein the electrical connector is a mezzanine-style electrical connector.

3. The electrical connector of claim 1, wherein the electrical connector is a right-angle electrical connector.

4. The electrical connector of claim 1, wherein the impedance of the differential signal pair is between 90 and 110 Ohms.

5. The electrical connector of claim 1, wherein the electrical connector is devoid of any ground contact adjacent to either of the first and second contacts.

6. The electrical connector of claim 1, wherein the data transfer rate of each of the respective electrical signals is about 10 Gigabits per second.

7. The electrical connector of claim 1, wherein the data transfer rate of each of the respective electrical signals is between about 10 to 20 Gigabits per second.

8. An electrical connector system comprising:

a first electrical connector comprising first and second electrical contacts; and a second electrical connector comprising third and fourth electrical contacts, wherein the third contact is adapted to receive the first contact and the fourth contact is adapted to receive the second contact, wherein the high-speed electrical connector system is devoid of any ground connection between the first and second electrical connectors, the first and second contacts form a differential signal pair, and each carries a respective electrical signal between the first electrical connector and the second electrical connector, each of the respective electrical signals having a data transfer rate of at least 1.0 gigabits/second.

9. The electrical connector system of claim 8, wherein the impedance of the differential signal pair is between 90 and 110 Ohms.

10. The electrical connector system of claim 8, wherein the electrical connector system is a mezzanine-style electrical connector, the first electrical connector is a mezzanine-style header connector, and the second electrical connector is a mezzanine-style receptacle connector.

11. The electrical connector system of claim 8, wherein the electrical connector is a right-angle electrical connector.

12. The electrical connector system of claim 8, wherein the first electrical connector is adapted to connect to a first electrical device having a first ground reference, the second electrical connector is adapted to connect to a second electrical device having a second ground reference, and the connector system is devoid of any ground connection that electrically connects the first ground reference and the second ground reference.

13. The electrical connector of claim 8, wherein the electrical connector is devoid of any ground contact adjacent to either of the first and second contacts.

14. A high-speed electrical connector comprising:

a connector housing; and first and second electrical contacts, each having a length that extends within the connector housing, wherein the high-speed electrical connector is devoid of any ground connection that extends along the length of the electrical contacts, the first and second contacts form a differential signal pair, and each carries a respective electrical signal between the electrical connector and a second electrical connector, each of the respective electrical signals having a data transfer rate of at least 1.0 gigabits/second.

15. The electrical connector of claim 14, wherein the connector housing is a right-angle connector housing.

16. The electrical connector of claim 14, wherein the connector housing is a mezzanine-style connector housing.

17. The electrical connector of claim 14, wherein the first electrical contact has a first end and a second end opposite the first end, and wherein the high-speed electrical connector is devoid of any ground connection that extends between the first and second ends of the first electrical contact.

18. The electrical connector of claim 14, wherein the impedance of the differential signal pair is between 90 and 110 Ohms.

19. The electrical connector of claim 18, wherein each of the first and second contacts carries an electrical signal having a data transfer rate of about 10 Gigabits per second.

20. The electrical connector of claim 18, wherein each of the first and second contacts carries an electrical signal having a data transfer rate of about 10 to 20 Gigabits per second.

21. A system, comprising:

a first electrical device having a first ground reference;

a second electrical device having a second ground reference; and an electrical connector comprising a differential signal pair of electrical contacts electrically connecting the first electrical device to the second electrical device, wherein the system is devoid of any ground connection electrically connecting the first ground reference to the second ground reference wherein the differential signal pair carries electrical signals between the first electrical device and the second electrical device, the electrical signals having a data transfer rate of at least 1.0 gigabits/second.

22. The system of claim 21, wherein the impedance of the differential signal pair is between 90 and 110 Ohms.

23. The system of claim 21, wherein the electrical connector is devoid of any ground contact adjacent to the differential signal pair.

24. The system of claim 21, wherein the electrical connector is a right-angle electrical connector.

25. An electrical connector for connecting a first electrical device having a first ground reference to a second electrical device having a second ground reference, the electrical connector comprising:

a connector housing; and a first electrical contact and a second electrical contact, each received in the connector housing and carrying a respective electrical signal from the first electrical device to the second electrical device, wherein the electrical connector is devoid of any ground connection that electrically connects the first ground reference and the second ground reference, the first and second contacts form a differential signal pair, and each of the electrical signals has a data transfer rate of at least 6.25 gigabits/second.

26. The electrical connector of claim 25, wherein the electrical connector is a mezzanine-style electrical connector.

27. The electrical connector of claim 25, wherein the electrical connector is a right-angle electrical connector.

28. The electrical connector of claim 25, wherein the impedance of the differential signal pair is between 90 and 110 Ohms.

29. The electrical connector of claim 25, wherein the electrical connector is devoid of any ground contact adjacent to either of the first and second contacts.

* * * * *